US006776072B2

(12) United States Patent
Poole et al.

(10) Patent No.: US 6,776,072 B2
(45) Date of Patent: Aug. 17, 2004

(54) ADJUSTABLE PLIERS WRENCH

(76) Inventors: Daniel L. Poole, 3319 W. Malapai Dr., Phoenix, AZ (US) 85051; Robert N. Poole, 39820 N. 7th St., Phoenix, AZ (US) 85027

( * ) Notice: Subject to any disclaimer, the term of this patent is extended or adjusted under 35 U.S.C. 154(b) by 0 days.

(21) Appl. No.: 10/464,625

(22) Filed: Jun. 18, 2003

(65) Prior Publication Data

US 2003/0221523 A1 Dec. 4, 2003

Related U.S. Application Data

(63) Continuation of application No. 09/909,365, filed on Jul. 19, 2001, now Pat. No. 6,591,719.

(51) Int. Cl.[7] ..... B25B 7/12
(52) U.S. Cl. ..... 81/370; 81/374
(58) Field of Search ..... 81/367, 368, 370, 81/374, 375

(56) References Cited

U.S. PATENT DOCUMENTS 3,208,319 A * 9/1965 Westby et al. ..... 81/367

* cited by examiner

*Primary Examiner*—James G. Smith
(74) *Attorney, Agent, or Firm*—Parsons & Goltry; Robert A. Parsons; Michael W. Goltry

(57) ABSTRACT

An adjustable pliers wrench including a fixture having a handle and an opposing stationary jaw, a co-acting jaw pivoted to the fixture and a lever pivoted to the co-acting jaw. A guide is attached proximate the handle and a locking element is arranged on the guide for reciprocal and canting movement. At least one attached biasing element urges the locking element toward the stationary jaw. An arm is pivoted to the lever and a cam is pivoted to the arm and to the locking element so as to be movable between a first condition permitting the locking element to reciprocate along the guide and a second condition bearing against the guide and canting the locking element into frictional engagement against the guide.

14 Claims, 3 Drawing Sheets

ADJUSTABLE PLIERS WRENCH

This application is a continuation patent application of application Ser. No. 09/909,365, filed Jul. 19, 2001, now U.S. Pat. No. 6,591,719, the entire contents of which are incorporated herein by reference.

FIELD OF THE INVENTION

This invention relates to self-locking, adjustable pliers wrenches.

BACKGROUND OF THE INVENTION

The art is sated with various self-locking adjustable pliers wrenches for gripping and locking onto objects within a rather wide size range. The innovations in such pliers are marked largely by improvements to the toggle mechanisms that permit the jaws to not only accommodate differently sized objects but also to lock onto the objects with varying degrees of force. Existing toggle mechanisms employ an adjustment component for use in adjusting the distance between the jaws so that they can grip and lock onto differently sized objects. The jaws must be pre-adjusted so that they can engage and grip an object, regardless of the size. As a result, existing self-locking adjustable pliers wrenches cannot be used with only one hand in the sequential gripping of differently sized objects, because a pre-adjustment of the jaws is required from the gripping of one object to the gripping of another differently sized object.

This required pre-adjustment of the jaws in the sequential gripping of differently sized objects is a significant deficiency in the art and it is clear that a adjustable wrench that could be employed for sequentially gripping differently sized objects with a selected gripping force without having to be sequentially pre-adjusted would mark a significant improvement over the prior art. The present invention achieves this and provides artisans with an adjustable pliers wrench that is easy to construct and easy to employ with only one hand for sequentially gripping differently sized objects without the need for sequentially pre-adjusting the jaws.

SUMMARY OF THE INVENTION

The above problems and others are at least partially solved and the above purposes and others realized in an improved self-locking, adjustable pliers wrench including a fixture having a handle and an opposing stationary jaw, a co-acting jaw pivoted to the fixture and a lever pivoted to the co-acting jaw and movable between opened and closed positions. Disposed between the handle and the lever is a toggle assembly. The jaws are movable between opened and closed conditions in response to movement of the lever between its opened and closed positions. The architecture of the toggle assembly permits the jaws to accommodate differently sized work pieces and causes the jaws to lock against a work piece positioned there between in the closed position of the lever.

The toggle assembly includes a guide, a locking element, a cam, an arm and an adjustment element. The guide is attached proximate the handle and the locking element is arranged on the guide for reciprocal and canting movements.

At least one attached biasing element urges the locking element toward the stationary jaw. The arm is pivoted to the lever. The cam is disposed angularly relative to the guide, and is pivoted to the arm and to the locking element so as to be movable in response to movement of the lever between its opened and closed positions between a first condition permitting the locking element to reciprocate along the guide and a second condition bearing against the guide and canting the locking element into frictional engagement against the guide. The arrangement between the arm, the cam and the guide is an articulating cam lever that acts on the locking element in response to movement of the lever between its opened and closed positions.

The adjustment element is associated with the arm and the cam and is adjustable in reciprocal directions for adjusting the angular disposition of the cam relative to the guide for altering the clamping pressure applied by the jaws across a work piece in the closed position of the lever. The adjustment element is carried by one of the arm and the cam and is adjustable in reciprocal directions in opposition to the other of the arm and the cam. The adjustment element is movable in reciprocal directions in response to rotation thereof and a threaded attachment between the adjustment element and the one of the arm and the cam is well suited for this. The biasing element includes a spring captured between the locking element and at least one of the guide and the handle.

BRIEF DESCRIPTION OF THE DRAWINGS

Referring to the drawings.

DETAILED DESCRIPTION OF A PREFERRED EMBODIMENT

Figure 1:
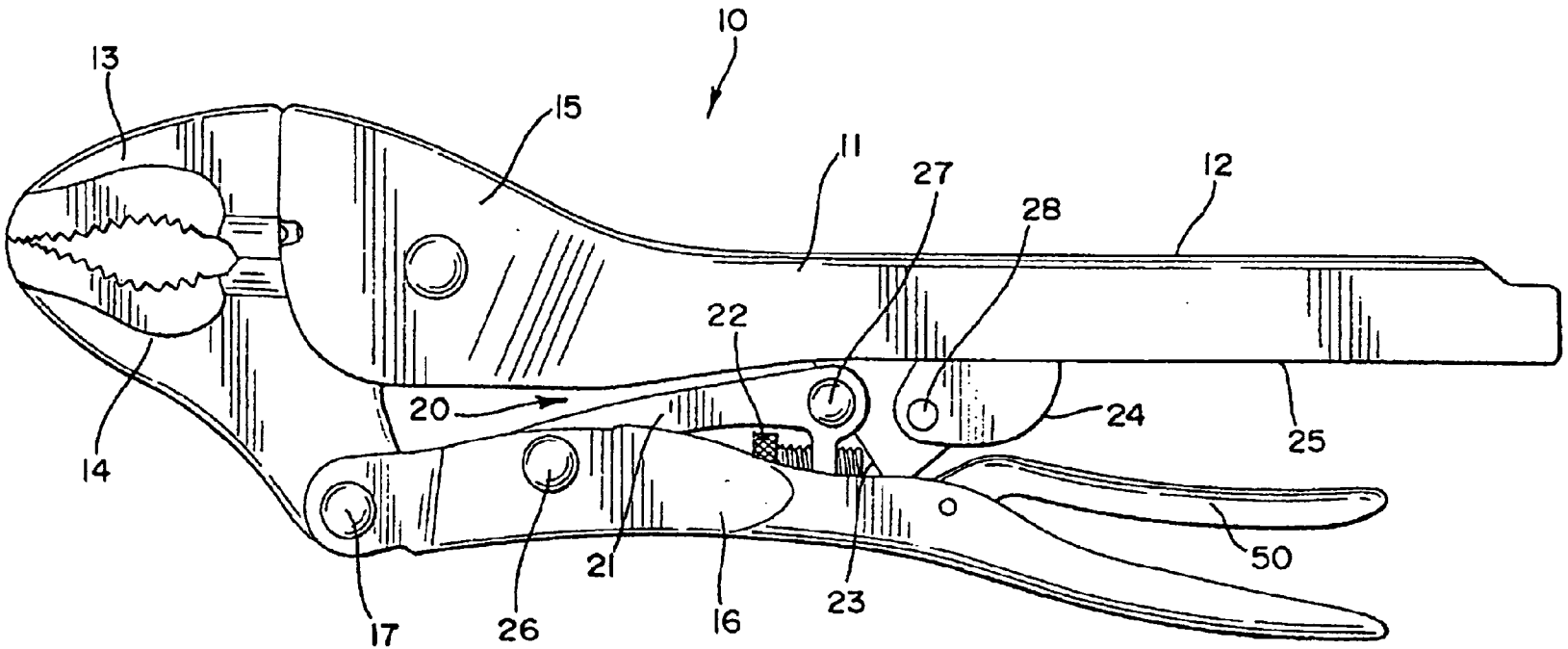
FIG. 1 is a side elevation of a self-locking, adjustable pliers wrench in accordance with the invention and shown as it would appear closed, the wrench having a release lever.
Figure 2:
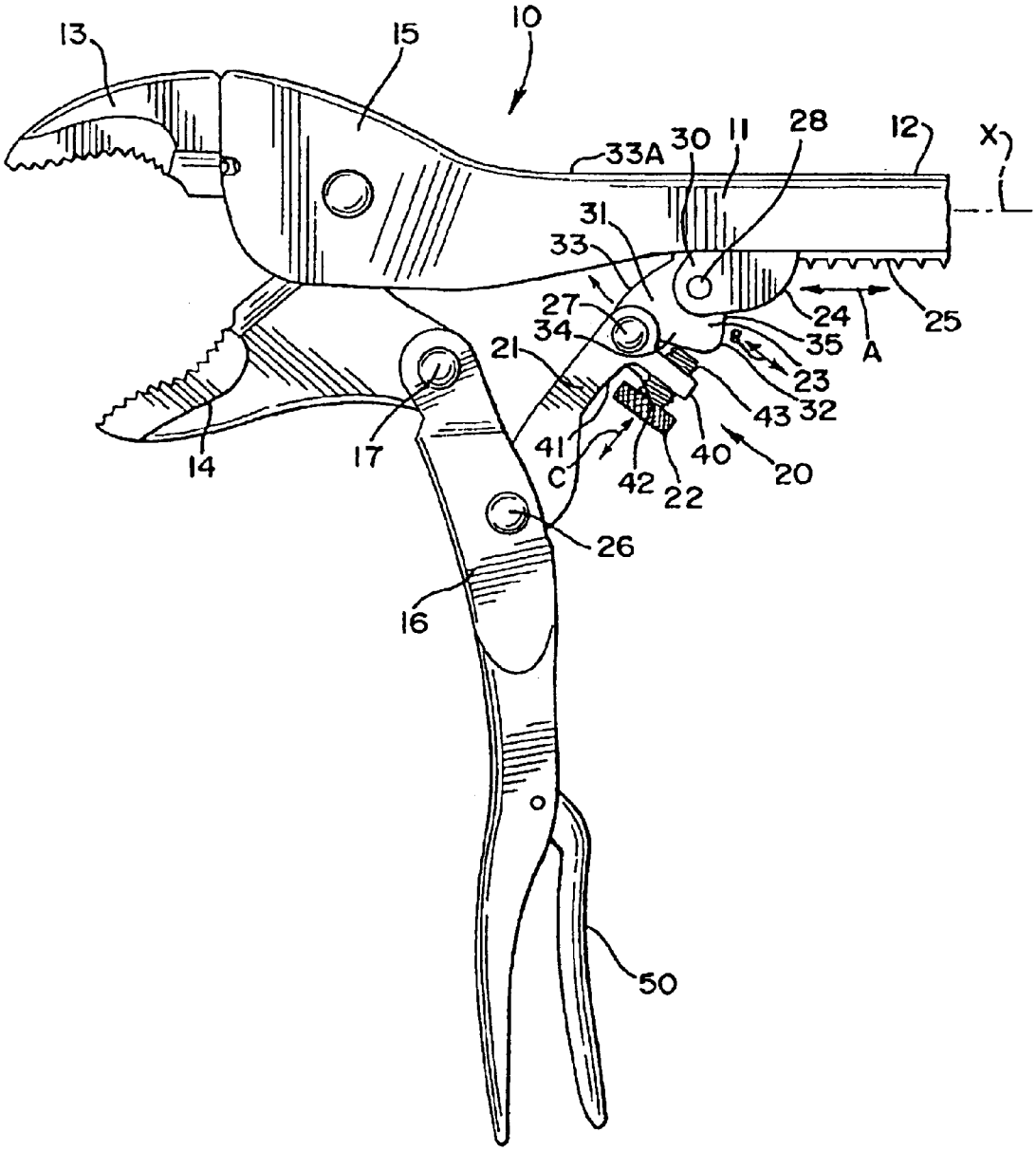
FIG. 2 is a side elevation of the wrench of FIG. 1 as it would appear opened.

FIGS. 1 and 2 are side elevations of a self-locking, adjustable pliers wrench 10 in accordance with the invention. Wrench 10 includes an elongate fixture 11 having a handle 12 at its rearward end and an opposing stationary jaw 13 at its forward end. A co-acting movable jaw 14 is pivoted to fixture 11 with a pivot pin 15. Jaw 14 is partially received in a recess formed into fixture 11 and this arrangement can be reversed. A lever 16 is pivoted to jaw 14 with a pivot pin 17 and extends rearwardly. Jaw 14 is partially received by a forward bifurcated end of lever 16 and this arrangement can be reversed.

A toggle assembly 20 is disposed between fixture 11 and lever 16 rearwardly of jaws 13,14. The structural components of toggle assembly 20 are best illustrated in FIG. 2, and include an arm 21, an adjustment element 22, a cam 23, a locking element 24 and a guide 25. Guide 25 is elongate, is disposed along substantially the entire length of handle 12 and is fixed to handle 12 by welding at its opposing ends. Those of ordinary skill will readily appreciate that guide 25 can be attached to handle 12 in other ways or formed into or with handle 12. Guide 25 passes through locking element 24 and resides in an elongate recess formed into handle 12. Locking element 24 is closely arranged on guide 25 for sliding/reciprocal movement along substantially the entire length of guide 12 in opposition to jaws 13,14 as indicated by the double arrowed line A and for canting movement as generally indicated by the double arrowed line B. The structure of at least one of handle 12 and guide 25 defines a forwardmost position of locking element 24, beyond which locking element 24 cannot pass and this position is shown substantially in FIG. 2 in an opened condition of wrench 10. Locking element 24 is partially received in the elongate recess formed into handle 12. Guide 25 defines a central axis X, and the ability of locking element 24 to cant on guide 25 is characterized by its ability to deviate angularly relative to axis X so as to frictionally engage guide 25. Arm 21 is pivoted to lever 16 with a pin 26 rearward of pin 17. A forward end of arm 21 is partially received in a recess formed into lever 16 and this arrangement can be reversed.

In shape cam 23 is generally triangular, which generally triangular shape is characterized by generally triangulated extremities 30,31,32 and sides 33,34,35. Cam 23 can be provided in other shapes suitable for functioning in substantially the same way for achieving the substantially same result as will be presently described. Extremity 30 is considered a rearward extremity and extremities 31,32 are considered forward extremities. Side 33 is characterized by an outwardly curved working surface 33A that faces fixture 11 and is angularly disposed relative thereto. Arm 21 is pivoted to cam 23 at an extension of extremity 31 with a pivot pin 27 and locking element 24 is pivoted to cam 23 at a somewhat rearward side of extremity 30 with a pivot pin 28. Cam 23 is partially received by a rearward bifurcated end of arm 21 and a forward bifurcated end of locking element 24, and each of these arrangements can be reversed.

An extension 40 of arm 21 opposes and is generally forward of extremity 32 and, more particularly, side 34 proximate extremity 32. A threaded opening extends through extension 40 and threadably accommodates adjustment element 22, which includes a head 42 located on the forward side of extension 40 and an opposing working end 43 facing extremity 32 and, more particularly, side 34 proximate extremity 32 on the rearward side of extension 40. Working end 43 is movable in reciprocal directions in opposition to side 34 proximate extremity 32 as indicated by the double arrowed line C in response to rotation of adjustment element 22, and such rotational force is best applied to head 42 as a matter of convenience. Other arrangements for facilitating reciprocal movement of adjustment element 22 can be employed, including a ratchet structure arrangement, etc. Adjustment element 22 can be similarly mounted to cam 23 so as to oppose and be reciprocally adjustable relative to extension 40 proximate its free or distal extremity if desired.

Lever 16 is movable between an opened position as shown in FIG. 2 and a closed position as shown in FIG. 1. In the opened position of lever 16, jaws 13,14 are opened and locking element 24 is located in or otherwise proximate its forward most position and working surface 33A is spaced from and angularly disposed relative to guide 25. In response to movement of lever 16 toward handle 12, jaw 14 moves toward jaw 13 until jaws 13,14 together engage a work piece disposed therebetween and arm 21 pivots at pin 26, which causes cam 23 to pivot toward guide 25 at pin 28. As arm 21 and cam 23 so pivot, working surface 33A moves toward guide 25 and the angular disposition of working surface 33A and arm 21 relative to guide 25 progressively lessens. With jaws 13,14 engaged against a work piece positioned therebetween, continued movement of lever 16 toward handle 12 drives toggle assembly 20, causing locking element 24 to slide rearwardly and arm 21 and cam 23 to pivot toward guide 25 until which point working surface 33A presents against guide 25. At the point of contact between working surface 33A and guide 25, cam 23 pivots ever so slightly away from guide 25 and drives locking element 24 away from guide 25 at pin 28, which causes locking element 24 to cant and thus frictionally engage guide 25. Cam 23 thus acts as a lever, driving locking element 24 so as to cause it to cant and frictionally engage guide 25 in response to a force applied to lever 16 in a direction toward handle 12, which force is transferred to cam 23 by arm 21. This frictional engagement frictionally locks locking element 24 to guide 25. In response to continued force applied to lever 16 toward handle 12 and with locking element 24 frictionally locked against guide 25, a clamping pressure is applied by jaws 13,14 across the work piece positioned therebetween and lever 16 is moved into its closed position. In the closed position of lever 16, an over-the-center locking occurs at arm 21 in relation to the pivoting action that takes place at pins 26 and 27, thus locking lever 16 in its closed position. This process takes place regardless of the size of the work piece positioned between jaws 13,14. To open wrench 10 or otherwise release jaws 13,14 from the work piece, lever 16 need only be forcibly moved out of its closed position. A conventional release lever 50 pivoted to lever 16 can be employed for acting against a portion of toggle assembly 20, namely, cam 23 in this specific example, for prying lever 16 out of its closed position.

When lever 16 is in its opened position and is moved toward handle 12, cam 23 pivots against working end 43 of adjustment element 22. In this starting position cam 23 is spaced from guide 25 and working surface 33A is disposed angularly relative to guide 25. The distance from and angular disposition of cam 23 relative to guide 25 when cam 23 abuts against working end 43 of adjustment element 22 in the starting position is determinative of the clamping pressure applied by jaws 13,14 across a work piece positioned therebetween when lever 16 is in its closed position as in FIG. 1. The closer cam 23 is to guide 25 and the lesser the angular disposition of cam 23 is relative to guide 25 in the starting position the farther rearward is the engagement of cam 23 to guide 25 and the coincident frictional engagement between locking element 24 and guide 25. The farther cam 23 is away from guide 25 and the greater the angular disposition of cam 23 is relative to guide 25 in the starting position the farther forward is the engagement of cam 23 to guide 25 and the coincident frictional engagement between locking element 24 and guide 25. Because the over-the-center clamping action provided between arm 21 and lever 16 and the coincident pressure applied by jaws 13,14 across a work piece positioned therebetween decreases the further rearwardly the frictional engagement occurs between locking element 24 and guide 25 and increases the further forwardly the frictional engagement occurs between locking element 24 and guide 25, adjustment of the clamping pressure is controlled by adjustment element 22. In this regard, adjusting working end 43 toward cam 23 increases the distance of cam 23 from guide 25 and increases the angular disposition of working surface 33A relative to guide 25, which results in an increased clamping pressure applied by jaws 13,14 across a work piece positioned therebetween in the closed position of lever 16. Adjusting working end 43 away from cam 23 decreases the distance of cam 23 from guide 25 and decreases the angular disposition of working surface 33A relative to guide 25, which results in a decreased clamping pressure applied by jaws 13,14 across a work piece positioned therebetween in the closed position of lever 16. Rather than engaging guide 25, cam 23 and handle 12 can be constructed and arranged to engage one another for causing a frictional engagement to occur between locking element 24 and guide 25 in the closed position of lever 16 if desired. As a matter of simplification, guide 25 can be considered to be part of handle 12.

A tension spring 51 encircles guide 25 and is captured by locking element 24 and at least one of guide 25 and handle 12. Spring 51 provides an outward bias, urging locking element 24 toward jaws 13,14. The action applied by spring 51 to locking element 24 enables a user to easily open lever 16 and thus jaws 13,14. Although spring 51 is mounted so as to directly interact with locking element 24, it can be attached in such a way so as to act on another part or parts of toggle assembly 20 so as to bias locking element 24 toward jaws 13,14. In addition to or in lieu of spring 51, a tension spring can be attached between toggle assembly 20 and one of lever 16 proximate its forward end, jaw 13, jaw 14 or at another location along fixture 11 proximate its forward end for pulling directly against locking element 24 or another part or parts of toggle assembly 20 so as to bias locking element 24 toward jaws 13,14. A combination of tension springs can also be employed if desired.

Figure 3:
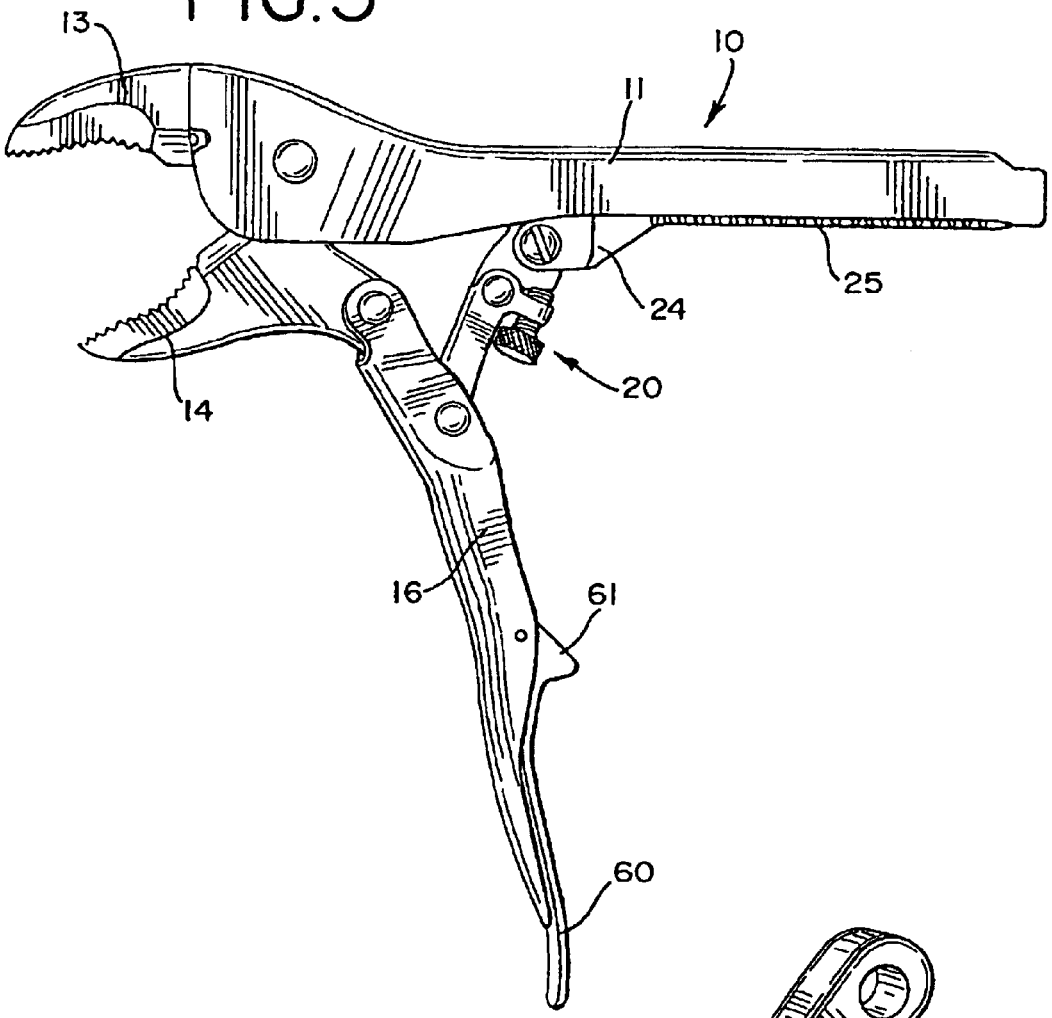
FIG. 3 is a view very similar to the view of FIG. 1 and further illustrating an alternate embodiment of a release lever.

Looking momentarily to FIG. 3, illustrated is a view of wrench 10 as it would appear opened and furnished with an alternate embodiment of a release lever designated at 60. Release lever 60 is pivoted at its forward end to lever 16 and includes a raised aspect 61 located proximate its forward end. In the closed position of lever 16 as in FIG. 1, lever 60 is pivoted toward fixture 11, which drives aspect 61 against locking element 24 so as to pry lever 16 out of its closed position. Lever 60 can be constructed and arranged to pivot aspect 61 against guide 25 or to other portions of fixture 11.

Figure 4:
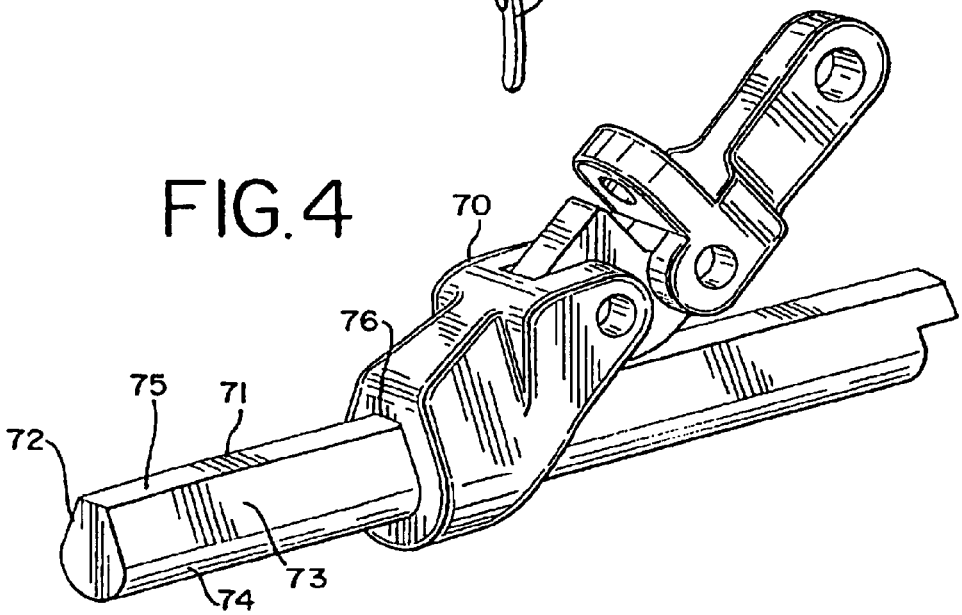
FIG. 4 is fragmented perspective view of locking element disposed with a guide.

Looking briefly to FIG. 4, illustrated is an alternate embodiment of a locking element 70 and guide 71 of a linkage assembly for use in connection with the invention. Locking element 70 and guide 71 are common in structure and function to locking element 24 and guide 25. However, unlike locking element 24 and guide 25 of wrench 10, guide 70 is fashioned with opposing chamfered surfaces 72,73 on either side thereof that meet at a rounded lower end 74 of guide 71 and to a substantially flat upper end 75 of guide 71. Guide 70 passes through an opening 76 of locking element 71 and is shaped in common with the cross-sectional shape of guide 70. In locking to guide 70, the combination of chamfered surfaces 72,73, rounded lower end 74 and substantially flat upper end 75 provide a considerably and surprisingly aggressive frictional engagement with opening 76 and such frictional engagement holds fast and firm and is not easily jiggled or worked free but only in response to the deliberate act of pivoting locking element 70 out of frictional engagement with guide 71.

The present invention has been described above with reference to a preferred embodiment. However, those skilled in the art will recognize that changes and modifications may be made in the described embodiments without departing from the nature and scope of the present invention. For instance, the pivotal attachments between the various components of wrench 10 as herein described are each facilitated with a pivot pin. Those have regard toward the art will readily appreciate that other ways of providing pivotal attachment can be used. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus comprising:

a fixture having a handle and an opposing stationary jaw;

a co-acting jaw pivoted to the fixture;

a lever pivoted to the co-acting jaw;

a guide disposed on the fixture proximate the handle, the guide including opposing chamfered surfaces joined by a rounded lower end and a flat surface at an upper end;

a locking element disposed on the guide for reciprocal and canting movement;

an arm pivoted to the lever; and a cam pivoted the arm and to the locking element and movable between a first condition permitting the locking element to reciprocate along the guide and a second condition bearing against the guide and canting the locking element into frictional engagement against the guide.

2. Apparatus of claim 1, the cam disposed angularly relative to the guide and engaging the flat surface thereof, further including an attached adjustment element for adjusting the angular disposition of the cam relative to the guide.

3. Apparatus of claim 2, wherein the adjustment element is carried by one of the arm and the cam.

4. Apparatus of claim 2, wherein the adjustment element is reciprocally adjustable in opposition to one of the arm and the cam.

5. Apparatus of claim 2, wherein the adjustment element is reciprocally adjustable in response to rotation thereof.

6. Apparatus of claim 1, further including a bias urging the locking element toward the stationary jaw.

7. Apparatus of claim 6, wherein the bias is provided by at least one attached biasing element.

8. In a device including a fixture having a handle and an opposing stationary jaw, a co-acting jaw pivoted to the fixture and a lever pivoted to the co-acting jaw, apparatus comprising:

a guide disposed on the fixture proximate the handle, the guide including opposing chamfered surfaces joined by a rounded lower end and a flat surface at an upper end;

a locking element disposed on the guide for reciprocal and canting movement, the locking element having an opening therethrough shaped in common with the cross-sectional shape of the guide;

an arm pivoted to the lever; and a cam pivoted to the arm and to the locking element and movable between a first condition permitting the locking element to reciprocate along the guide and a second condition bearing against the guide and canting the locking element into frictional engagement against the guide.

9. Apparatus of claim 8, the cam disposed angularly relative to the guide and engaging the flat surface thereof, further including an attached adjustment element for adjusting the angular disposition of the cam relative to the guide.

10. Apparatus of claim 9, wherein the adjustment element is carried by one of the arm and the cam.

11. Apparatus of claim 9, wherein the adjustment element is reciprocally adjustable in opposition to one of the arm and the cam.

12. Apparatus of claim 9, wherein the adjustment element is reciprocally adjustable in response to rotation thereof.

13. Apparatus of claim 8, further including a bias urging the locking element toward the stationary jaw.

14. Apparatus of claim 13, wherein the bias is provided by at least one attached biasing element.

* * * * *